US008334821B2

(12) United States Patent
Lee

(10) Patent No.: US 8,334,821 B2
(45) Date of Patent: Dec. 18, 2012

(54) PLASMA DISPLAY AND DRIVING METHOD THEREOF

(75) Inventor: Sang-Gu Lee, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 1023 days.

(21) Appl. No.: 12/285,207

(22) Filed: Sep. 30, 2008

(65) Prior Publication Data

US 2009/0091518 A1 Apr. 9, 2009

(30) Foreign Application Priority Data

Oct. 4, 2007 (KR) ..... 10-2007-0099796

(51) Int. Cl.
*G09G 3/28* (2006.01)

(52) U.S. Cl. ..... 345/60; 345/211

(58) Field of Classification Search ..... 345/60, 345/211

See application file for complete search history.

(56) References Cited

U.S. PATENT DOCUMENTS

| | | | | |
|---|---|---|---|---|
| 6,686,912 | B1 * | 2/2004 | Kishi et al. | 345/211 |
| 7,365,709 | B2 | 4/2008 | Kim et al. | |
| 2002/0047589 | A1 | 4/2002 | Myoung et al. | |
| 2005/0057451 | A1 | 3/2005 | Lim | |
| 2005/0083259 | A1 * | 4/2005 | Kim et al. | 345/60 |
| 2005/0225510 | A1 * | 10/2005 | Ito et al. | 345/60 |
| 2005/0280024 | A1 | 12/2005 | Kim et al. | |
| 2006/0061521 | A1 | 3/2006 | Kim | |
| 2006/0164336 | A1 | 7/2006 | Yang et al. | |
| 2008/0158102 | A1 * | 7/2008 | Han | 345/60 |
| 2008/0180033 | A1 | 7/2008 | Lee | |
| 2009/0033232 | A1 * | 2/2009 | Kim et al. | 315/169.4 |
| 2009/0040208 | A1 * | 2/2009 | Kim | 345/211 |

FOREIGN PATENT DOCUMENTS

| | | | |
|---|---|---|---|
| CN | 1 811 877 | A | 8/2006 |
| KR | 10-20050000110 | A | 1/2005 |
| KR | 10-0578933 | B1 | 5/2006 |
| KR | 10-0586605 | B1 | 5/2006 |

* cited by examiner

*Primary Examiner* — Amr Awad
*Assistant Examiner* — Bassam Noaman
(74) *Attorney, Agent, or Firm* — Lee & Morse, P.C.

(57) ABSTRACT

In a plasma display device, a first transistor is connected between an electrode and a power source supplying a first voltage, and a second transistor is connected to a control terminal of the first transistor. A first gate driver supplies a first control signal to the control terminal of the first transistor and is connected to the control terminal of the first transistor. A second gate driver supplies a second control signal to the second transistor, and is connected to the control terminal of the second transistor. Further, a diode is connected between an output terminal of the second gate driver and the control terminal of the first transistor.

18 Claims, 7 Drawing Sheets

PLASMA DISPLAY AND DRIVING METHOD THEREOF

BACKGROUND OF THE INVENTION

1. Field of the Invention

Embodiments relate to a plasma display device and driving method thereof.

2. Description of the Related Art

A plasma display panel (PDP) is a flat panel display that uses plasma generated by gas discharge to display characters or images. The PDP includes a plurality of discharge electrode pairs and a plurality of address electrodes crossing the plurality of discharge electrode pairs.

The plasma display device divides a frame into a plurality of subfields each having a luminance weight value, and displays a grayscale by a combination of weight values of subfields in which a display operation is generated among the plurality of subfields. Light emitting cells and non-light emitting cells are selected by an address discharge during an address period of each subfield, and an image is actually displayed by a sustain discharge performed in the light emitting cells during a sustain period.

The sustain discharge occurs only when a voltage difference between two electrodes is set to be greater than a predetermined voltage. Currently, voltage levels used for each electrode in the address period and sustain period are different. Accordingly, individual power sources for supplying each voltage are needed, increasing the number of power sources.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments are therefore directed to a plasma display and a driving method thereof, which substantially overcomes one or more of the disadvantages of the related art.

It is therefore a feature of an embodiment to provide a plasma display and a driving method thereof having a reduced number of power sources.

It is yet another feature of an embodiment to provide a plasma display device and a driving method thereof that can provide stable operation, even if discharge characteristics vary.

At least one of the above and other features and advantages may be realized by providing a plasma display device including an electrode, a first transistor, a first gate driver, a second transistor, and a first diode. The first transistor is connected between the electrode and a power source for supplying a first voltage, with a voltage of a first terminal corresponding to a voltage of the electrode and a voltage of a second terminal corresponding to the first voltage. The first gate driver supplies a first control signal to a control gate of the first transistor. The second transistor is connected between a control terminal of the first transistor and the power source, and the second gate driver supplies a second control signal to a control terminal of the second transistor. The first diode is connected between an output terminal of the second gate driver and the control terminal of the first transistor.

At least one of the above and other features and advantages may be realized by providing a plasma display device including an electrode, a first transistor, a first driver, a second transistor, a gate driver, and a current path. The first transistor is connected between the electrode and a power source for supplying a first voltage, with a voltage of a first terminal corresponding to a voltage of the electrode and a voltage of a second terminal corresponding to the first voltage. The first driver changes the voltage of the electrode by controlling driving of the first transistor. The second transistor turns off the second transistor when it is turned on, and the gate driver outputs a control signal of a first level to a control terminal of the second transistor for turning off the second transistor. The current path transmits the control signal of the first level to the control terminal of the second transistor. At this time, the first transistor is turned on according to the control signal of the first level.

At least one of the above and other features and advantages may be realized by providing a driving method for a plasma display device including an electrode. According to the method, a first transistor connected between the electrode and a power source for supplying a first voltage controls using a first control signal to gradually decrease a voltage of the electrode to a second voltage, which is lower than a first voltage, during a first period of a reset period, and a second transistor connected between a control terminal of the first transistor and the power source is repeatedly turned on/turned off using a second control signal to gradually decrease a voltage of the electrode from the second voltage to a third voltage.

According to example embodiments, since voltages each having a different level can be provided with a single power source, the number of power sources of the plasma display device can be decreased. Further, since the voltage level of the voltage Vnf and the voltage slope of the Y electrode in the reset may change, even if the discharge characteristics vary, the plasma display device can perform steady operation.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION OF THE INVENTION

Figure 1:
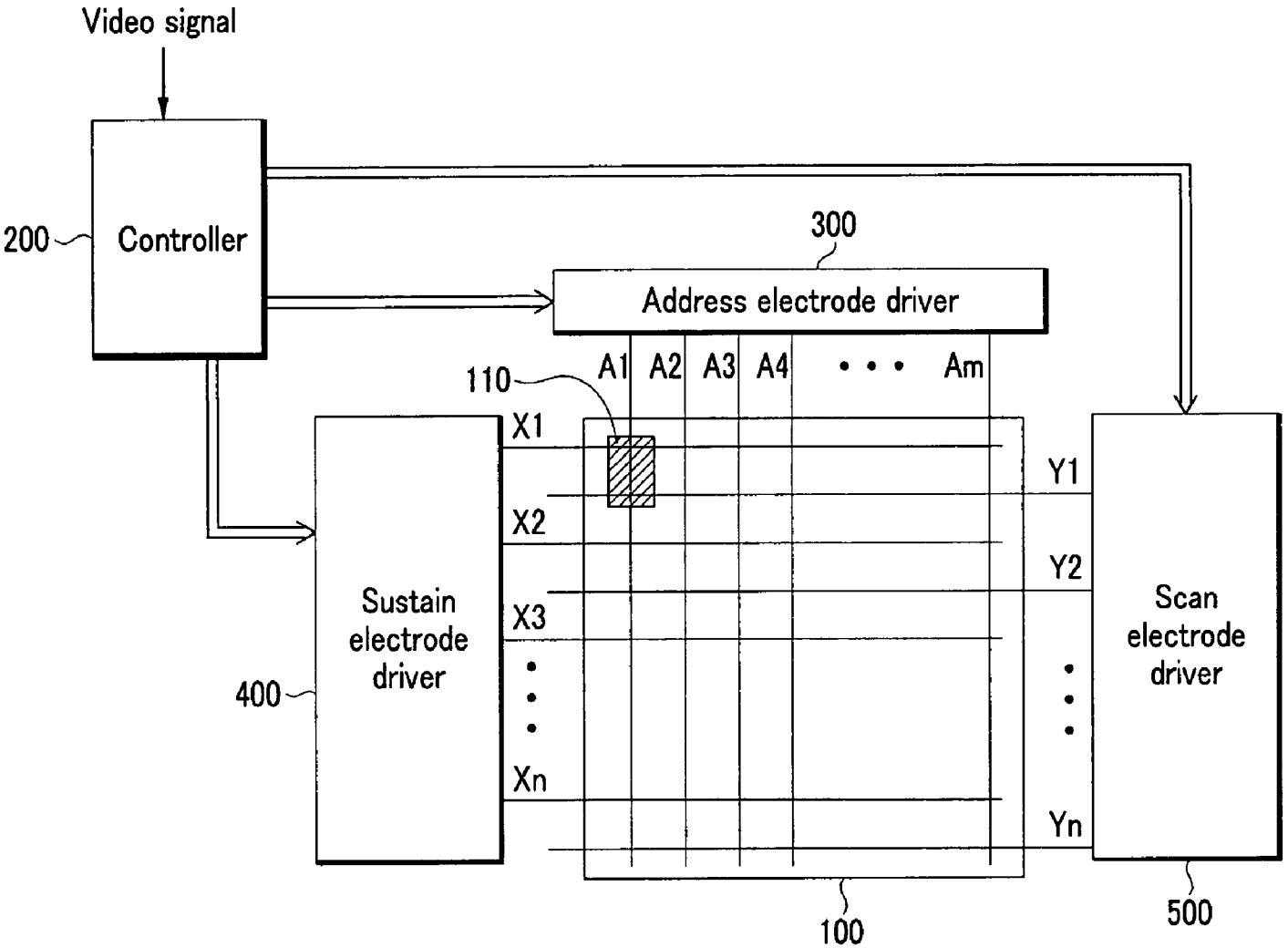
FIG. 1 illustrates a plasma display device according to an exemplary embodiment of the present invention.

Korean Patent Application No. 10-2007-0099796, filed on Oct. 4, 2007, in the Korean Intellectual Property Office, and entitled: "Plasma Display, and Driving Method Thereof," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include an nth member, where n is greater than 3, whereas the expression "at least one selected from the group consisting of A, B, and C" does not.

As used herein, the expression "or" is not an "exclusive or" unless it is used in conjunction with the term "either." For example, the expression "A, B, or C" includes A alone; B alone; C alone; both A and B together; both A and C together; both B and C together; and all three of A, B and, C together, whereas the expression "either A, B, or C" means one of A alone, B alone, and C alone, and does not mean any of both A and B together; both A and C together; both B and C together; and all three of A, B and C together.

Throughout the specification, if something is described to "include constituent elements", it may further include other constituent elements unless it is described that is does not include other constituent elements. Throughout this specification and the claims that follow, when it is described that an element is "coupled" to another element, the element may be directly coupled to the other element or "coupled" to the other element through a third element.

In the present invention, a wall charge is a charge formed close to each electrode on the wall of a cell, for example a dielectric layer. Although the wall charges do not actually touch the electrodes, the walds1 charges will be described as being "formed" or "accumulated" on the electrode. Also, a wall voltage is a potential difference formed at the wall of a cell by wall charges. A weak discharge is a discharge that is weaker than a sustain discharge in a sustain period and an address discharge in an address period.

The plasma display device and driving method thereof according to exemplary embodiments of the present invention will now be described in detail.

FIG. 1 illustrates a diagram of a plasma display device according to an exemplary embodiment of the present invention. As shown in FIG. 1, the plasma display according to the exemplary embodiment of the present invention may include a plasma display panel (PDP) 100, a controller 200, an address electrode driver 300, a sustain electrode driver 400, and a scan electrode driver 500.

The PDP 100 may include a plurality of address electrodes A1 to Am extending in a column direction, and a plurality of sustain and scan electrodes X1 to Xn and Y1 to Yn extending in a row direction in pairs. In general, the sustain electrodes X1 to Xn are respectively formed to correspond to the scan electrodes Y1 to Yn. The sustain electrodes and scan electrodes may perform a display operation for displaying an image in a sustain period.

The scan electrodes Y1 to Yn and the sustain electrodes X1 to Xn may cross the address electrodes A1 to Am. Discharge spaces at crossing regions of the address electrodes A1 to Am and the sustain and scan electrodes X1 to Xn and Y1 to Yn form discharge cells 110

It is to be noted that the above construction of the PDP is only an example, and panels having different structures, to which a driving waveform to be described later can be applied, may be applied to the present invention.

The controller 200 may receive an external video signal, and may output an address electrode driving control signal, a sustain electrode driving control signal, and a scan electrode driving control signal. The address electrode driver 300 may apply a driving voltage to the plurality of A electrodes A1 to Am according to the driving control signal from the controller 200. The scan electrode driver 500 may apply a driving voltage to the plurality of Y electrodes Y1 to Yn according to the driving control signal from the controller 200. The sustain electrode driver 400 may apply a driving voltage to the plurality of X electrodes X1 to Xn according to the driving control signal from the controller 200.

Next, a driving waveform that is applied to the A electrodes A1-Am, the X electrodes X1-Xn and the Y electrodes Y1-Yn in each subfield will be described in detail with reference to FIG. 2.

Figure 2:
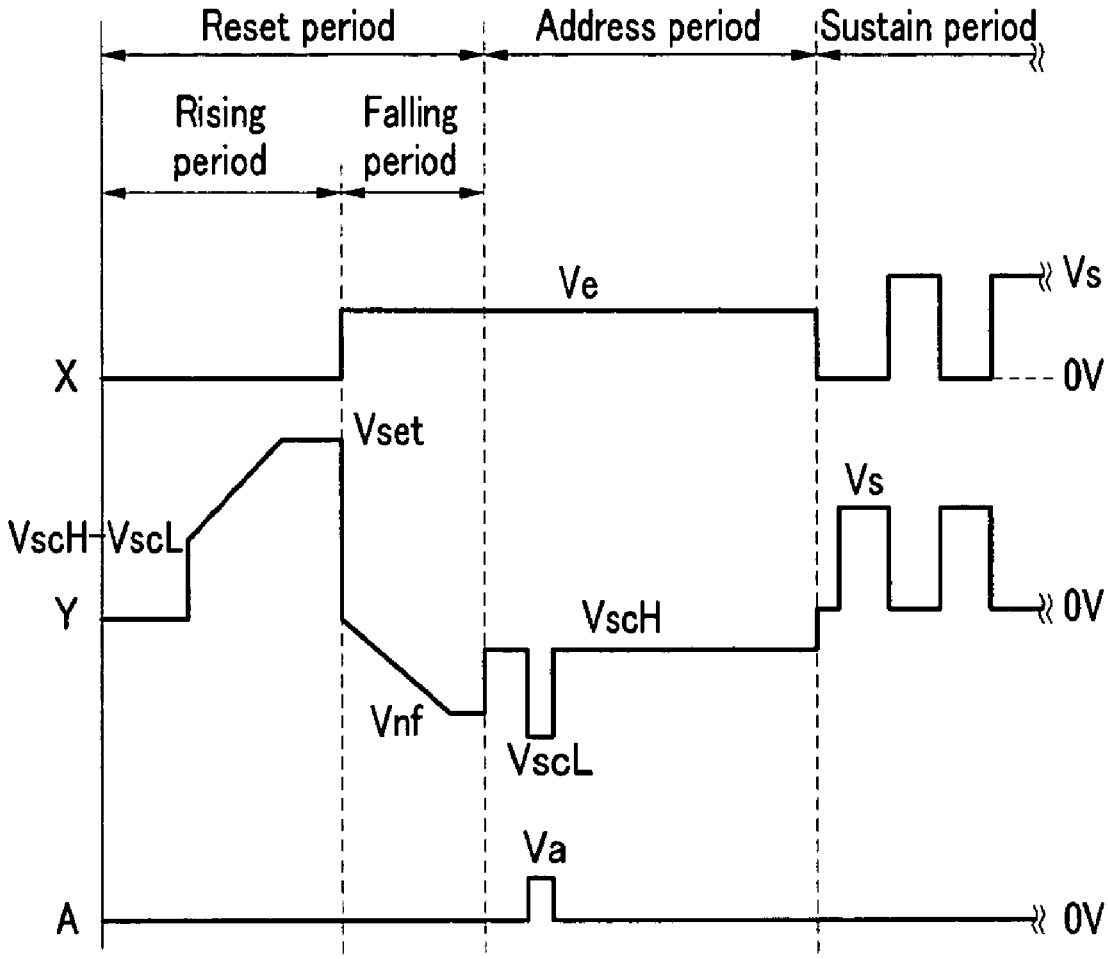
FIG. 2 illustrates a driving waveform of the plasma display device according to an exemplary embodiment of the present invention.

FIG. 2 illustrates a driving waveform of the plasma display device according to an exemplary embodiment of the present invention. In FIG. 2, the driving waveform will be described with reference to a cell formed by an A electrode, an X electrode, and a Y electrode.

As shown in FIG. 2, during a rising period of a reset period, the address electrode driver 300 and the sustain electrode driver 400 bias the A electrode and the X electrode to a reference voltage (0V in FIG. 2), respectively, and the scan electrode driver 500 rapidly increases the voltage of the Y electrode from the reference voltage to a voltage (VscH-VscL) and then gradually increases the voltage of the Y electrode from the voltage (VscH-VscL) to a voltage Vset. In FIG. 2, the voltage of the Y electrode is shown to increase in a ramp pattern.

While the voltage of the Y electrode is increasing, a weak discharge occurs between the Y and X electrodes and between Y and A electrodes, forming negative (−) wall charges on the Y electrode and positive (+) wall charges in the X and A electrodes. The voltage Vset may be larger than a discharge firing voltage between the X electrode and the Y electrode in order to induce discharge at all cells.

Subsequently, during a falling period of the reset period, the sustain electrode driver 400 biases the X electrode with a voltage Ve, the scan electrode driver 500 gradually decreases the voltage of the Y electrode from the voltage Vset to a voltage Vnf, and the address electrode driver 300 maintains the address electrode A at the reference voltage. In FIG. 2, the voltage of the Y electrode is shown to be decreased in the ramp pattern.

While the voltage of the Y electrode is decreasing, a weak discharge occurs between the Y and X electrodes and between the Y and A electrodes, erasing the negative (−) wall charges formed on the Y electrode and the positive (+) wall charges formed on the X and A electrodes. In general, the voltage Ve and the voltage Vnf may be set so that the wall voltage between the Y electrode and the X electrode is near 0V in order to prevent a misfiring discharge in a non-light emitting cell. That is, a voltage (Ve-Vnf) may be close to the discharge firing voltage between the Y electrode and the X electrode.

In an address period, in order to select a light emitting cell, the sustain electrode driver 400 maintains the voltage of the X electrode at the voltage Ve, and the scan electrode driver 500 and the address electrode driver 300 apply a scan pulse having the voltage VscL and an address pulse having the voltage Va to the Y electrode and the A electrode, respectively. Further, the scan electrode driver 500 applies the voltage VscH, which is higher than the voltage of VscL to a non-selected Y electrode and the address electrode driver 300 applies the reference voltage to the A electrode of a non-light emitting cell. The voltage VscL may be equal to or lower than the voltage Vnf.

In detail, during the address period, the scan electrode driver 500 and the address electrode driver 300 apply scan pulses to the Y electrode (Y1 in FIG. 1) of a first row and, at the same time, apply address pulses to the A electrodes positioned at light emitting cells in the first row.

Then, address discharges occur between the Y electrodes (Y1 in FIG. 1) of the first row and the A electrodes to which the address pulses have been applied, forming positive (+) wall charges in the Y electrode (Y1 in FIG. 1) and negative (−) wall charges in the A and X electrodes. Subsequently, while the scan electrode driver 500 applies scan pulses to the Y electrode (Y2 in FIG. 1) of a second row, the address electrode driver 300 applies address pulses to the A electrodes positioned at light emitting cells of the second row. Then, address discharges occur at cells formed by the A electrodes to which the address pulses have been applied and the Y electrode (Y2 in FIG. 1) of the second row, forming wall charges in the cells. Likewise, while the scan electrode driver 500 sequentially applies scan pulses to the Y electrodes of the remaining rows, and the address electrode driver 300 applies address pulses to the A electrodes positioned at light emitting cells to form wall charges.

In general, when the voltage Vnf is applied in the reset period, the sum of a wall voltage between the A and Y electrodes and the external voltage between the A and Y electrodes is determined by the discharge firing voltage between the A and Y electrodes. When 0V is applied to the A electrodes and the voltage VscL (=Vnf) voltage is applied to the Y electrodes, the discharge firing voltage between the A and Y electrodes is formed between the A and Y electrodes and a discharge can occur, but in this case, because a discharge delay time is longer than the width of the scan pulse and the address pulse, no discharge occurs.

Meanwhile, when the voltage Va is applied to the A electrodes and the voltage VscL (=Vnf) is applied to the Y electrodes, a voltage that is higher than the discharge firing voltage between the A and Y electrodes may be formed between the A and Y electrodes, reducing the discharge delay time to be smaller than the width of the scan pulse, so a discharge can occur. At this time, if the voltage VscL is set to be lower than the voltage Vnf, a voltage difference (VscL−Va) between the Y and A electrodes would increase to make an address discharge desirably occur. Alternatively or additionally, the voltage Va may be decreased up to as much as the voltage difference VscL−Vnf.

Thus, generally, during the address period, the voltage VscL may be equal to or lower than the voltage Vnf, and the voltage Va may be higher than the reference voltage.

In the sustain period, the scan electrode driver 500 applies the sustain pulse alternately having a high level voltage (Vs in FIG. 2) and a low level voltage (0V in FIG. 2) to the Y electrodes a number of times corresponding to a weight value of the corresponding subfield.

In addition, the sustain electrode driver 400 applies a sustain pulse to the X electrodes in a phase that is opposite to that of the sustain pulse applied to the Y electrodes. That is, 0V is applied to the X electrode when a Vs voltage is applied to the Y electrode, and the Vs voltage is applied to the X electrode when 0V is applied to the Y electrode. In this case, the voltage difference between the Y electrode and the X electrode alternately has a Vs voltage and a −Vs voltage. Accordingly, the sustain discharge repeatedly occurs at light emitting cells as many times as the predetermined number.

Alternatively, during the sustain period, sustain discharge pulses alternately having a voltage Vs and a voltage −Vs as a voltage difference of the Y and X electrodes may be applied to the Y electrodes and/or X electrodes. For example, when the X electrodes are biased with the ground voltage, sustain discharge pulses having the voltage Vs and the voltage −Vs may be applied to the Y electrodes.

Also, FIG. 2 shows that after cells are initialized to non-light emitting cells by erasing the wall charges in the cells during the reset period, cells are set as light emitting cells through the address discharges during the address period. Alternatively, after setting the cells to light emitting cells by writing the wall charges in the cells in the reset period or after the sustain period of the previous subfields, the cells may be set as non-light emitting cells through the address discharges during the address period.

Figure 3:
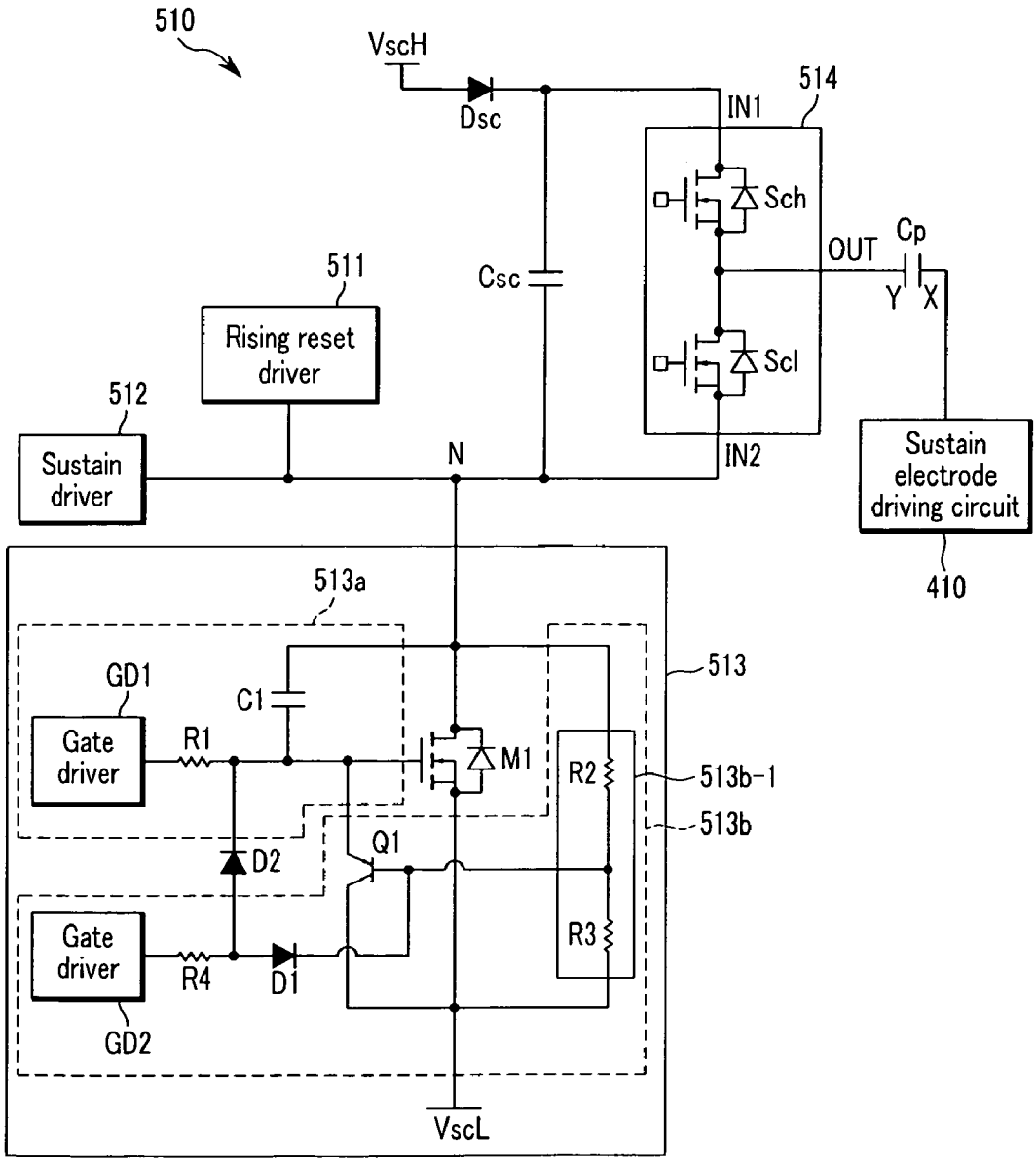
FIG. 3 illustrates a scan electrode driving circuit according to the first exemplary embodiment of the present invention.

A driving circuit for applying different levels (e.g., Vnf and VscL) of voltages with a single power source will be described in detail with reference to FIG. 3. FIG. 3 illustrates a scan electrode driving circuit 510 according to an exemplary embodiment.

The scan electrode driving circuit 510 as shown in FIG. 3 may be connected to the plurality of Y electrodes Y1 to Yn, and may be formed in the scan electrode driver 500 of FIG. 1. A sustain electrode driving circuit 410 may be connected to the plurality of X electrodes X1 to Xn, and may be formed in the sustain electrode driver 400 of FIG. 1. FIG. 3 shows only a single Y electrode for better understanding and ease of description. A capacitive component formed by the single Y electrode and a single X electrode is represented as a panel capacitor Cp.

As shown in FIG. 3, the scan electrode driving circuit 510 may include a rising reset driver 511, a sustain driver 512, a falling reset/scan driver 513, a scan circuit 514, a capacitor Csc, and a diode Dsc.

The scan circuit 514 may include a high side input terminal IN1 and a low side input terminal IN2, and an output terminal OUT connected with the Y electrode. The scan circuit 514 may selectively apply a voltage of the high side input terminal IN1 and a voltage of the low side input terminal IN2 to the corresponding Y electrode.

Although FIG. 3 illustrates the single scan circuit 514 connected with the Y electrode, the scan circuit 514 may actually be connected with the plurality of Y electrodes (Y1~Yn in FIG. 1). Alternatively, a certain number of scan circuits 514 may be formed as a single scan integrated circuit, and a plurality of output terminals of the scan integrated circuit may be connected with a certain number of Y electrodes (i.e., Y1~Yk, where K is an integer smaller than n).

The scan circuit 514 may include transistors Sch and Scl. A source of the transistor Sch and a drain of the transistor Scl may be connected with the Y electrode. A drain of the transistor Sch may be connected with the high side input terminal IN1 of the scan circuit 514. A source of the transistor Scl may be connected with the low side input terminal IN2 of the scan circuit 514.

A power source VscH for applying the voltage VscH may be connected with the high side input terminal IN1 of the scan circuit 514. An anode of the diode Dsc may be connected with the power source VscH and a cathode of the diode Dsc may be connected with the high side input terminal IN1 of the scan circuit 514.

The capacitor Csc may be connected in parallel between the high side input terminal IN1 of the scan circuit 514 and the low side input terminal IN2 of the scan circuit 514. The capacitor Csc may be charged with a voltage VscH-VscL.

The falling reset/scan driver 513 may be connected to a node N. The node N may be connected with the low side input terminal IN2 of the scan circuit 514. The falling reset/scan driver 513 may include a transistor M1, a diode D2, and drivers 513*a* and 513*b*. The driver 513*a* may include a capacitor C1, a resistor R1, and a gate driver GD1. The driver 513*b* may include a transistor Q1, resistors R2, R3, and R4, and a gate driver GD2. The transistor M1 is illustrated as n-channel field effect transistor, particularly an n-channel metal oxide semiconductor (NMOS) transistor, and the transistor Q1 is illustrated as a pnp transistor. However, other transistors that can perform similar function may be used for the transistors M1 and Q1.

The transistor M1 may have a drain connected with the node N and a source connected with a power source for applying the voltage VscL. The capacitor C1 may have a first terminal connected with the drain of the transistor M1 and a second terminal connected with a gate, i.e., a control terminal, of the transistor M1. The resistor R1 may have a first terminal connected to a second terminal of the capacitor C1 and a second terminal connected with the gate driver GD1. The transistor M1 may be driven by the driver 513*a* to decrease the voltage of the Y electrode in a ramp pattern.

The two resistors R2 and R3 may be connected in series between the drain of the transistor M1 and the power source VscL. A contact of the two resistors R2 and R3 may be connected with a base, i.e., a control terminal, of the transistor Q1.

The two resistors R2 and R3 may operate as a voltage divider 513*b*-1 for dividing a voltage difference between a voltage of the node N and the voltage VscL. A collector of the transistor Q1 may be connected with the power source VscL. An emitter of the transistor Q1 may be connected with the gate of the transistor M1. A cathode of the diode D1 may be connected with the base of the transistor Q1. An anode of the diode D1 may be connected to an output terminal of the gate driver GD2. The resistor R1 may be connected between the gate driver GD1 and the cathode of the diode D2. The resistor R4 may be connected between the output terminal of the gate driver GD2 and the anode of the diode D2. When the voltage of the Y electrode reaches a certain level (e.g., Vnf), the driver 513*b* may turn on the transistor Q1 to cut off a path between the transistor M1 and the power source VscL.

The resistor R1 may have a high resistance, e.g., 1 kΩ, and may decrease the voltage of the Y electrode in a ramp pattern in the gate driver GD1. The resistor R4 may have a resistance, e.g., 10Ω, lower than the resistance of the resistor R1, and may immediately turn on/turn off the transistor Q1.

The anode of the diode D2 may be connected with the output terminal of the gate driver GD2. The cathode of the diode D2 may be connected with the gate of the transistor M1. Accordingly, the transistor M1 may be controlled by a control signal for turning on/turning off the transistor Q1.

The sustain driver 512 may be connected with the node N and may apply the sustain pulses to the Y electrode through the low side input terminal IN2 of the scan circuit 514 during the sustain period. The rising reset driver 511 may be connected with the node N and may increase the voltage of Y electrode through the low side input terminal IN2 of the scan circuit 514 during the rising period of the reset period.

Figure 4:
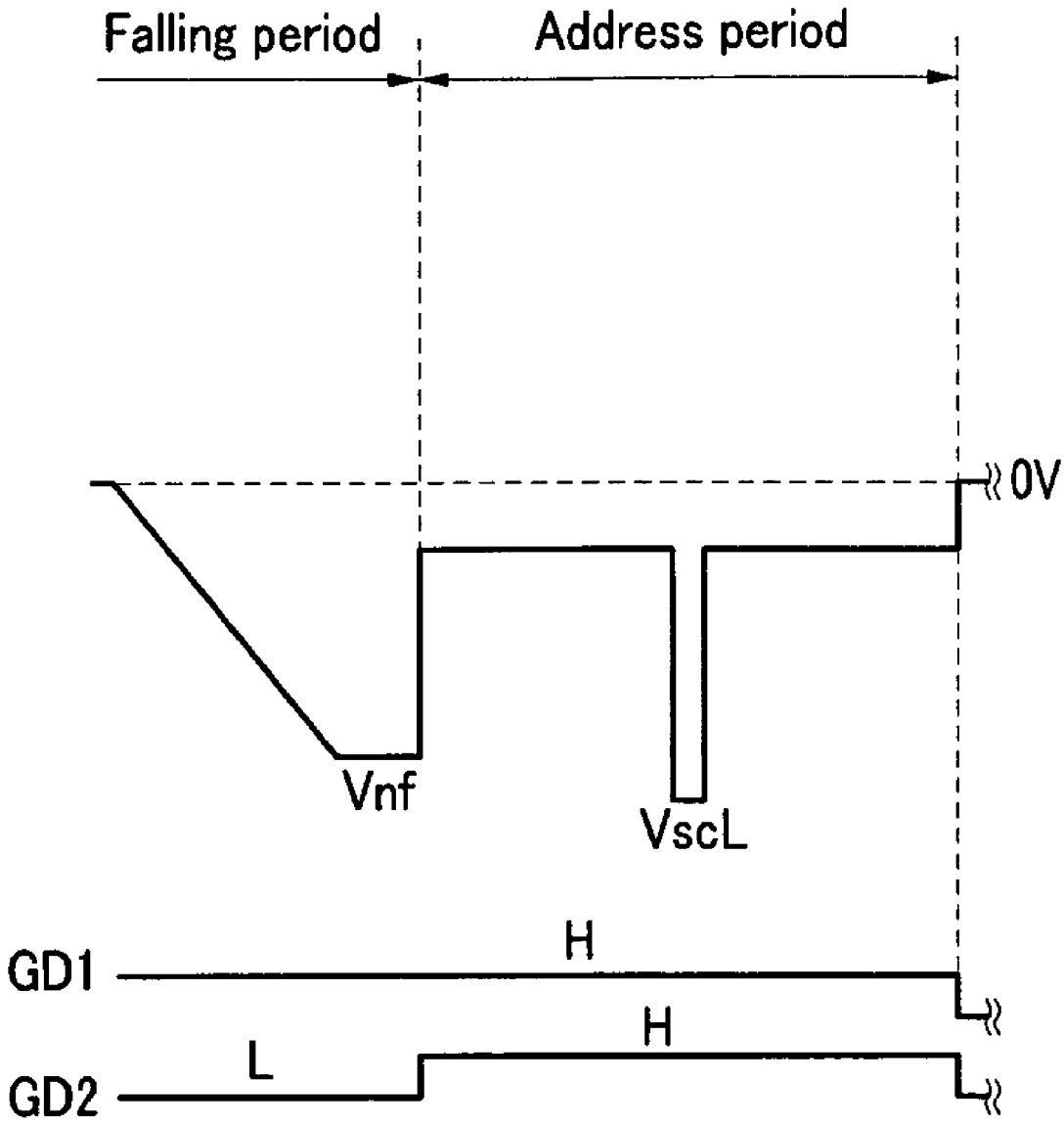
FIG. 4 illustrates a timing of the scan electrode driving circuit shown in FIG. 3.
Figure 5A:
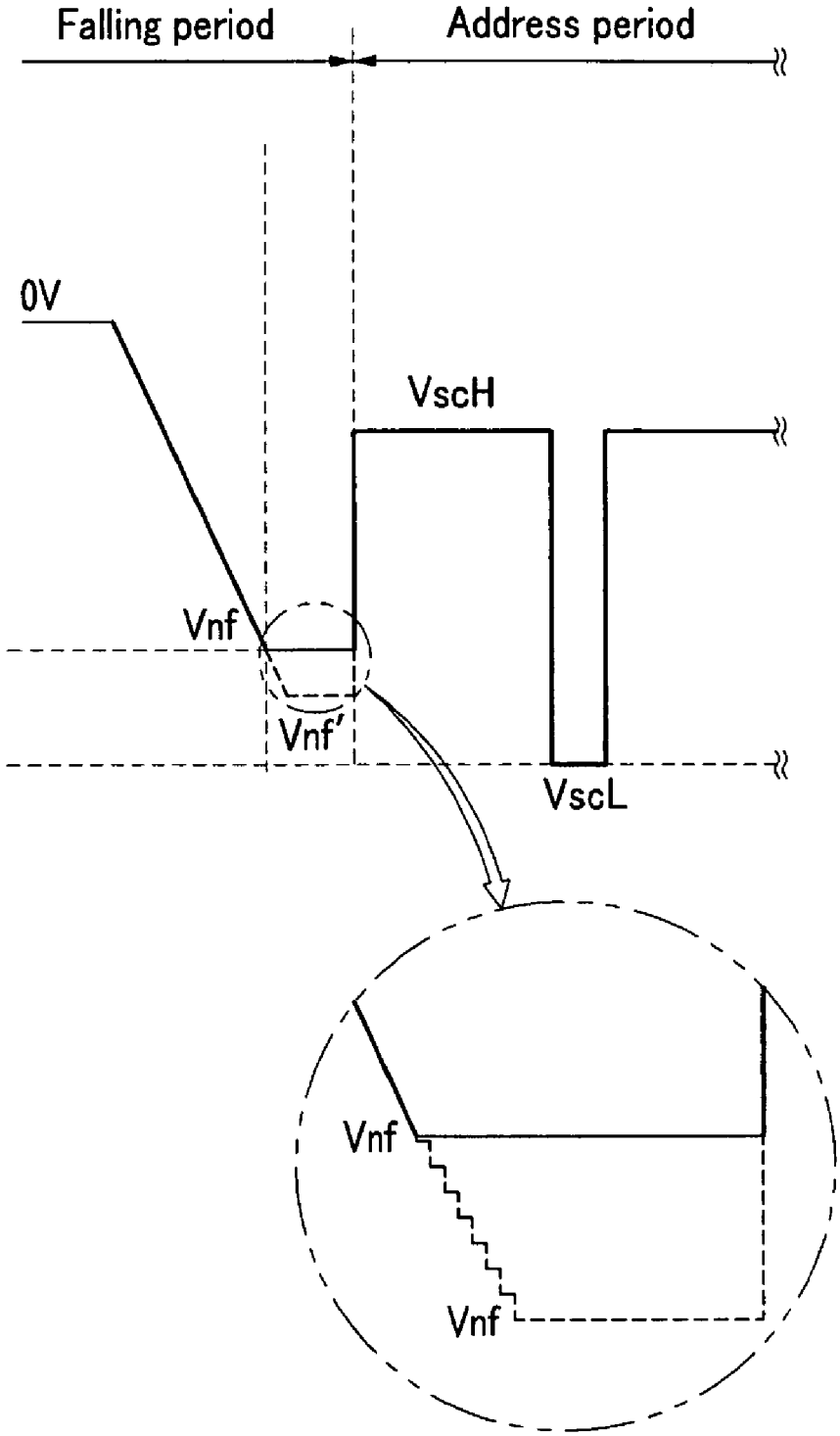
FIG. 5A and FIG. 5B illustrate Vnf voltage and slope of the Vnf voltage generated by the scan electrode driving circuit, respectively.
Figure 5B:
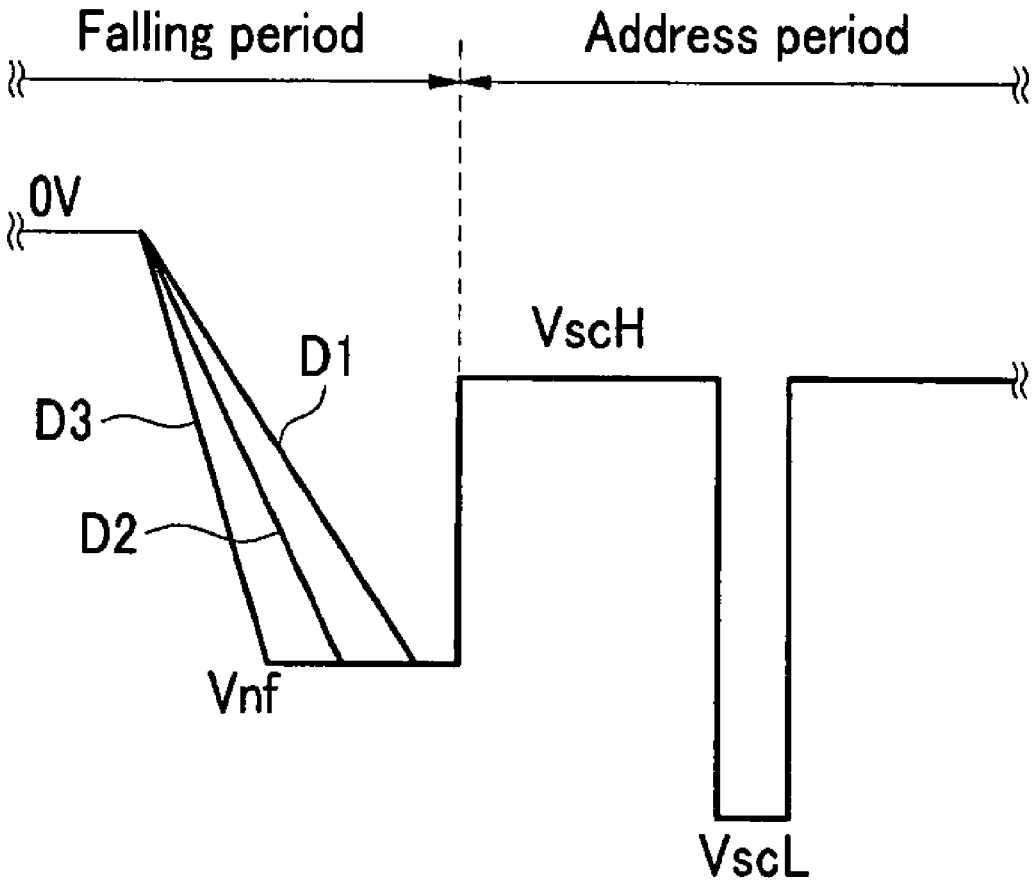

Operation of the falling reset/scan driver 513 will be described in detail with reference to FIGS. 4, 5A, and 5B. FIG. 4 illustrates a timing of the scan electrode driving circuit shown in FIG. 3. FIG. 5A and FIG. 5B illustrate the voltage Vnf and the slope of the voltage Vnf generated by the scan electrode driving circuit 510, respectively.

Since a voltage is applied to the Y electrode through the low side input terminal IN2 of the scan circuit 514 during the reset period, the voltage of the Y electrode is equal to the voltage of the node N. It is assumed that the voltage reference voltage (e.g., 0V) is applied to the Y electrode before the falling ramp voltage is applied to the Y electrode in the falling period of the reset period.

As shown in FIG. 4, during the falling period of the reset period, the gate driver GD1 outputs a high level signal H to the gate of the transistor M1, and the gate driver GD2 outputs a low level signal L to the base of the transistor Q1. Then, the transistor M1 is turned on and, since a voltage divided by the two resistors R2 and R3 is higher than a voltage of the low level signal L, the transistor Q1 is turned off. Thus, the voltage of the Y electrode gradually decreases.

In detail, when the gate driver GD1 outputs the high level signal H, a gate voltage of the transistor M1 may increase by a capacitance component formed by the capacitor C1 and a parasitic capacitance of the transistor M1, and a path formed by the resistor R1. Then, the transistor M1 is turned on while the gate voltage increases, so the voltage of the Y electrode decreases through the path of the panel capacitor Cp, the transistor M1, and the power source VscL. As the voltage of the Y electrode decreases, the gate voltage of the transistor M1 decreases due to the capacitor C1. Thus, the transistor M1 is turned off.

Again, the gate voltage of the transistor M1 may gradually increase by the high level signal H output from the gate driver GD1, so the transistor M1 is turned on, and the voltage of the Y electrode decreases. In this manner, as the transistor M1 is repeatedly turned on and off, the voltage of the Y electrode gradually decreases.

Subsequently, when the voltage of the Y electrode decreases to a certain voltage Vx, the voltage Vx is divided by the two resistors R2 and R3, and a base-collector voltage Vbc of the transistor Q1 may be represented by Equation 1:

$$Vbc = VscL + (Vx - VscL)\frac{R3}{(R2 + R3)} \tag{1}$$

In addition, when the base-collector voltage Vbc becomes less than a threshold voltage Vth as represented by Equation 2, the transistor Q1 is turned on.

$$Vbc = VscL + (Vx - VscL)\frac{R3}{(R2 + R3)} \leq |Vth| \tag{2}$$

When the transistor Q1 is turned on, since a gate-source voltage of the transistor M1 becomes 0V, the transistor M1 is turned off. That is, the voltage Vx present when the base-collector voltage Vbc of the transistor Q1 is substantially equal to the threshold voltage |Vth| is determined as the voltage Vnf, and the Y electrode may be maintained at the voltage Vnf for a predetermined period.

In the address period, the gate driver GD2 outputs the high level signal H to the base of the transistor Q1. Then, the transistor Q1 is turned off, and the voltage of the Y electrode gradually decreases to the voltage VscL by the repeated turning on and off of the transistor M1. At this time, when the transistor Scl of the scan circuit 514 is turned-on, the voltage VscL may be applied to the Y electrode.

In general, when a difference between the voltage Vnf and the voltage VscL increases, the address discharge occurs more stably. However, since discharge characteristics of the plasma display device may vary with temperature or other environmental factors, the difference between the voltage Vnf and the voltage VscL should also be varied accordingly to insure stable address discharge.

Without the diode D2, the voltage Vnf is a single voltage level as determined by the resistance values of the resistors R2 and R3. Then, when the discharge characteristics of the plasma display device vary, the discharge characteristics between the Y electrode and the A electrode may be unstable. However, when the diode D2 is included, as illustrated in FIG. 3, since on/off states of the transistors M1 and Q1 may be controlled in accordance with the control signal output from the gate driver GD2, the voltage Vnf may change according to the discharge characteristics of the plasma display device as shown in FIG. 5A.

That is, the gate driver GD2 may alternately output a high level signal H and a low level signal L in a portion of the falling period of the reset period in which the voltage of Y electrode is lower than the voltage Vnf. Then, the high level signal H and the low level signal L may be transmitted to the gate of transistor M1 through a current path formed by the resistor R4, the diode D2, and the gate of the transistor M1. Thus, the transistor M1 may be repeatedly turned on and off, and the voltage of Y electrode may be decreased to a voltage Vnf' that is lower than the voltage Vnf.

In addition, in a period in which the voltage of Y electrode decreases during the falling period of the reset period, when turn-on/turn-off states of transistors M1 and Q1 are controlled using a control signal output from the gate driver GD2, a voltage slope of the Y electrode may also be controlled. That is, since the resistance of the resistor R1 is greater than the resistance of the resistor R4, the control signal output from the gate driver GD2 may immediately turn-on/turn-off the transistor M1 rather than the control signal output from the gate driver GD1. Thus, in the period in which the voltage of Y electrode decreases, a voltage slope of the Y electrode may be different according to the number of control signals output from the gate driver GD2 for turning on the transistor M1. That is, the voltage slope may change rapidly in a D1→D2→D3 direction as the number of control signals output increases as shown in FIG. 5B. The discharge is influenced by the voltage slope, and when the voltage slope controls discharge according to discharge characteristics, discharge may occur steadily.

Figure 6:
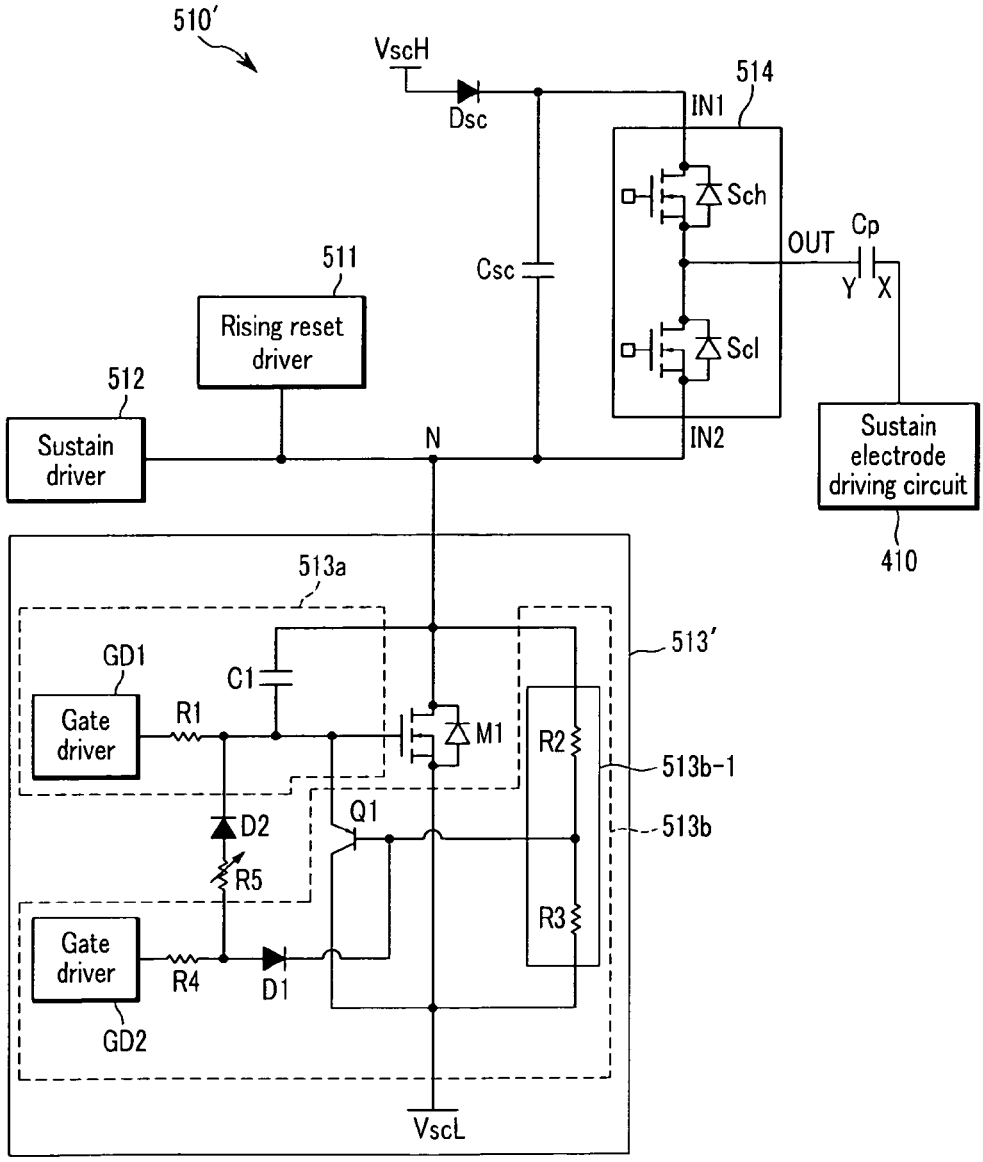
FIG. 6 illustrates a scan electrode driving circuit according to the second exemplary embodiment of the present invention.

A driving circuit for controlling the voltage slope of the Y electrode is illustrated in FIG. 6. FIG. 6 illustrates a scan electrode driving circuit 510' according to a second exemplary embodiment.

As shown in FIG. 6, the scan electrode driving circuit 510' according to the second exemplary embodiment may be the same as the scan electrode driving circuit 510 according to the first exemplary embodiment except for a driver 513'. In addition to elements of the driver 513, the driver 513' may further include a variable resistor R5. The variable resistor R5 may be connected in series between the gate of the transistor M1 and the gate driver GD2. When a resistance of the variable resistor R5 is controlled, a voltage slope of the Y electrode may be controlled in the falling period of the reset period. That is, when the resistance of the variable resistor R5 increases, the voltage slope is shallower, and when the resistance of the variable resistor R5 decreases, the voltage slope is steeper.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display, comprising:

an electrode;

a first transistor connected between the electrode and a power source, the first transistor configured to supply a first voltage, a voltage of a first terminal of the first transistor corresponding to a voltage of the electrode and a voltage of a second terminal of the first transistor corresponding to the first voltage;

a first gate driver configured to supply a first control signal to a control terminal of the first transistor;

a second transistor connected between the control terminal of the first transistor and the power source;

a second gate driver configured to supply a second control signal to a control terminal of the second transistor;

a first diode connected between an output terminal of the second gate driver and the control terminal of the first transistor;

a first resistor connected between the output terminal of the first gate driver and a cathode of the first diode; and a second resistor connected between an output terminal of the second gate driver and an anode of the first diode, wherein a resistance of the first resistor is greater than a resistance of the second resistor.

2. The plasma display as claimed in claim 1, further comprising:

a third resistor connected between the output terminal of the second gate driver and the control terminal of the first transistor, and connected in series to the first diode.

3. The plasma display as claimed in claim 2, wherein the third resistor is a variable resistor.

4. The plasma display as claimed in claim 1, further comprising:

a second diode connected to the output terminal of the second gate driver and the control terminal of the second transistor.

5. The plasma display as claimed in claim 1, further comprising:

third and fourth resistors connected in series between the first terminal of the first transistor and the power source, with a contact connected to the control terminal of the second transistor.

6. The plasma display as claimed in claim 1, wherein a channel type of the first transistor is opposite to a channel type of the second transistor.

7. The plasma display as claimed in claim 1, wherein, during a first period of a reset period, the first gate driver is configured to set the first control signal at a high level to gradually decrease the voltage of the electrode to the second voltage that is lower than the first voltage and, during an address period, the second gate driver is configured to set the first and second control signals at a high level to turn on the second transistor.

8. The plasma display as claimed in claim 7, wherein, during a second period of the reset period, the second gate driver is configured to set the second control signal to alternately have a high level and a low level to decrease a voltage of the electrode to a third voltage that is lower than the second voltage.

9. The plasma display as claimed in claim 7, wherein the second gate driver is configured to output the second control signal of the high level during part of the first period.

10. A plasma display, comprising:

an electrode;

a first transistor connected between the electrode and a power source configured to supply a first voltage, a voltage of a first terminal corresponding to a voltage of the electrode and a voltage of a second terminal corresponding to the first voltage;

a first driver configured to change the voltage of the electrode by controlling driving of the first transistor;

a second transistor configured to turn off the first transistor when turned on;

a gate driver configured to output a control signal of a first level to a control terminal of the second transistor to turn off the second transistor; and a current path for transmitting the control signal of the first level to the control terminal of the second transistor, wherein the first transistor is turned on according to the control signal of the first level, wherein the current path includes a diode connected between the gate driver and a control terminal of the first transistor, and further including a first resistor connected between the output terminal of the first driver and a cathode of the diode; and a second resistor connected between an output terminal of the gate driver and an anode of the diode, wherein a resistance of the first resistor is greater than a resistance of the second resistor.

11. The plasma display as claimed in claim 10, further comprising a variable resistor connected in series with the diode.

12. The plasma display as claimed in claim 10, further comprising:

a voltage divider configured to divide a voltage of the first terminal of the first transistor and the first voltage, and to transmit the divided voltage to the control terminal of the second transistor, wherein the second transistor is turned on when the control signal is a second level and the divided voltage is lower than a second voltage that is higher than the first voltage.

13. The plasma display as claimed in claim 12, wherein:

the gate driver is configured to output the control signal of the first level to the control terminal of the second transistor to gradually decrease the voltage of the electrode to the second voltage during a first period of a reset period, and the gate driver is configured to alternately output the control signal of the second level for turning on the second transistor and the control signal of the first level to decrease the voltage of the electrode to a third voltage that is lower than the second voltage during a second period of the reset period.

14. The plasma display as claimed in claim 12, wherein:

the gate driver is configured to output the control signal of the first level to the control terminal of the second transistor to gradually decrease the voltage of the electrode to the second voltage during a first period of a reset period, and the gate driver is configured to output a control signal of a second level for turning on the second transistor during a second period of the reset period.

15. A method of driving a plasma display device including an electrode, the method comprising:

connecting a first resistor between an output terminal of a first gate driver and a cathode of a first diode;

connecting a second resistor between an output terminal of a second gate driver and an anode of the first diode, a resistance of the first resistor being greater than a resistance of the second resistor;

supplying a first control signal from the first gate driver to a control terminal of a first transistor connected between the electrode and a power source, the first diode being connected between the output terminal of the second gate driver and the control terminal of the first transistor;

supplying a second control signal from the second gate driver to a control terminal of a second transistor connected between the control terminal of the first transistor and the power source;

controlling the first transistor to supply a first voltage in accordance with the first control signal to gradually decrease a voltage of the electrode to a second voltage, lower than the first voltage, during a first period of a reset period; and repeatedly turning on/turning off the second transistor in accordance with the second control signal to gradually decrease the voltage of the electrode from the second voltage to a third voltage during a second period of the reset period.

16. The method as claimed in claim 15, wherein the second control signal has a high level and a low level, the method further comprising:

setting the second control signal at the high level to turn off the second transistor during the first period; and alternately setting the second control signal as the high level and the low level to the turn on/turn off the second transistor.

17. The method as claimed in claim 15, the method further comprising:

setting the first and second control signals as the high level to turn off the second transistor, and turning on the first transistor to apply the first voltage to the electrode during an address period.

18. The method as claimed in claim 15, further comprising varying a slope of the voltage of the electrode during a falling period of the reset period.

* * * * *